US011537061B2

(12) United States Patent
Iriyama et al.

(10) Patent No.: US 11,537,061 B2
(45) Date of Patent: Dec. 27, 2022

(54) IMAGE FORMING APPARATUS, AND CONTROL METHOD FOR THE SAME

(71) Applicant: BROTHER KOGYO KABUSHIKI KAISHA, Nagoya (JP)

(72) Inventors: Shota Iriyama, Toyokawa (JP); Keigo Nakajima, Nagoya (JP); Toshio Furukawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/552,651

(22) Filed: Dec. 16, 2021

(65) Prior Publication Data

US 2022/0206409 A1 Jun. 30, 2022

(30) Foreign Application Priority Data

Dec. 25, 2020 (JP) ..... JP2020-217932

(51) Int. Cl.
*G03G 15/06* (2006.01)

(52) U.S. Cl.
CPC ..... *G03G 15/065* (2013.01)

(58) Field of Classification Search
CPC ..... G03G 16/065
USPC ..... 399/38, 53, 55
See application file for complete search history.

(56) References Cited

U.S. PATENT DOCUMENTS

| | | | | |
|---|---|---|---|---|
| 10,274,865 | B2 * | 4/2019 | Furuta | G03G 15/5041 |
| 10,444,691 | B2 * | 10/2019 | Watanabe | G03G 15/0216 |
| 11,022,922 | B2 * | 6/2021 | Saito | G03G 15/5058 |
| 2006/0233559 | A1 | 10/2006 | Sugita et al. | |
| 2011/0182604 | A1 | 7/2011 | Otsuka et al. | |
| 2015/0185654 | A1 | 7/2015 | Ogiso et al. | |

FOREIGN PATENT DOCUMENTS

| | | | |
|---|---|---|---|
| JP | 2007-114596 | A | 5/2007 |
| JP | 2011-154146 | A | 8/2011 |
| JP | 2015-125432 | A | 7/2015 |
| JP | 2019-120726 | A | 7/2019 |

* cited by examiner

*Primary Examiner* — Hoan H Tran
(74) *Attorney, Agent, or Firm* — Scully, Scott, Murphy & Presser, PC

(57) ABSTRACT

There is provided image forming apparatus including: photosensitive member; developing roller configured to supply a developer to the photosensitive member; belt to which a developer image is to be transferred from the photosensitive member; sensor; and controller configured to execute a developing bias correcting process for correcting a developing bias to be applied to the developing roller. The developing bias correcting process includes: a setting process for setting testing biases, all of the testing biases being smaller than an old developing bias; a forming process for forming developer images on the belt by using the testing biases set in the setting process; a detecting process for detecting densities of the developer images formed in the forming process by the sensor; and a calculating process for calculating the developing bias based on the densities of the developer images detected in the detecting process.

13 Claims, 8 Drawing Sheets

IMAGE FORMING APPARATUS, AND CONTROL METHOD FOR THE SAME

CROSS REFERENCE TO RELATED APPLICATIONS

The present application claims priority from Japanese Patent Application No. 2020-217932, filed on Dec. 25, 2020, the disclosure of which is incorporated herein by reference in its entirety.

BACKGROUND

The present disclosure relates to an image forming apparatus such as a printer or the like, and a control method for the same.

An image forming apparatus is known as a conventional technique in which developing biases are corrected by preparing and reading toner patches corresponding to the plurality of developing biases respectively in order to maintain a target printing density. In such a technique, the most recent developing bias, which is assumed to be close to the target printing density, is used as a reference, and toner patches, which correspond to developing biases higher and lower than the reference in relation to electric potentials, are generated to correct the developing bias.

SUMMARY

According to a first aspect of the present disclosure, there is provided an image forming apparatus including a photosensitive member, a developing roller, a belt, a sensor, and a controller.

The developing roller is configured to supply a developer to the photosensitive member.

A developer image formed by the developer is to be transferred to the belt from the photosensitive member.

The sensor is configured to detect a density of the developer image on the belt.

The controller is configured to execute a developing bias correcting process for correcting a developing bias to be applied to the developing roller.

The developing bias correcting process includes:

- a setting process for setting a plurality of testing biases to be applied to the developing roller, all of the plurality of testing biases being smaller than an old developing bias used for forming an image on a sheet before executing the developing bias correcting process;
- a forming process for forming a plurality of developer images on the belt by using the plurality of testing biases set in the setting process;
- a detecting process for detecting densities of the plurality of developer images formed in the forming process by the sensor; and
- a calculating process for calculating the developing bias based on the densities of the plurality of developer images detected in the detecting process.

According to a second aspect of the present disclosure, there is provided a control method for an image forming apparatus provided with a photosensitive member, a developing roller configured to supply a developer to the photosensitive member, and a belt to which a developer image formed by the developer is to be transferred from the photosensitive member.

The control method is used in a case that a developing bias correcting process for correcting a developing bias to be applied to the developing roller is executed.

The control method includes:

setting a plurality of testing biases to be applied to the developing roller, all of the plurality of testing biases being smaller than an old developing bias used for forming an image on a sheet before executing the developing bias correcting process, and forming a plurality of developer images on the belt by using the plurality of testing biases; and calculating the developing bias based on densities of the plurality of developer images on the belt.

BRIEF DESCRIPTION OF THE DRAWINGS

FIG. 4 on the right side is a drawing to show the range of the change of the density of the developer image corresponding to each of the exposure area ratios.

DETAILED DESCRIPTION

Figure 1:
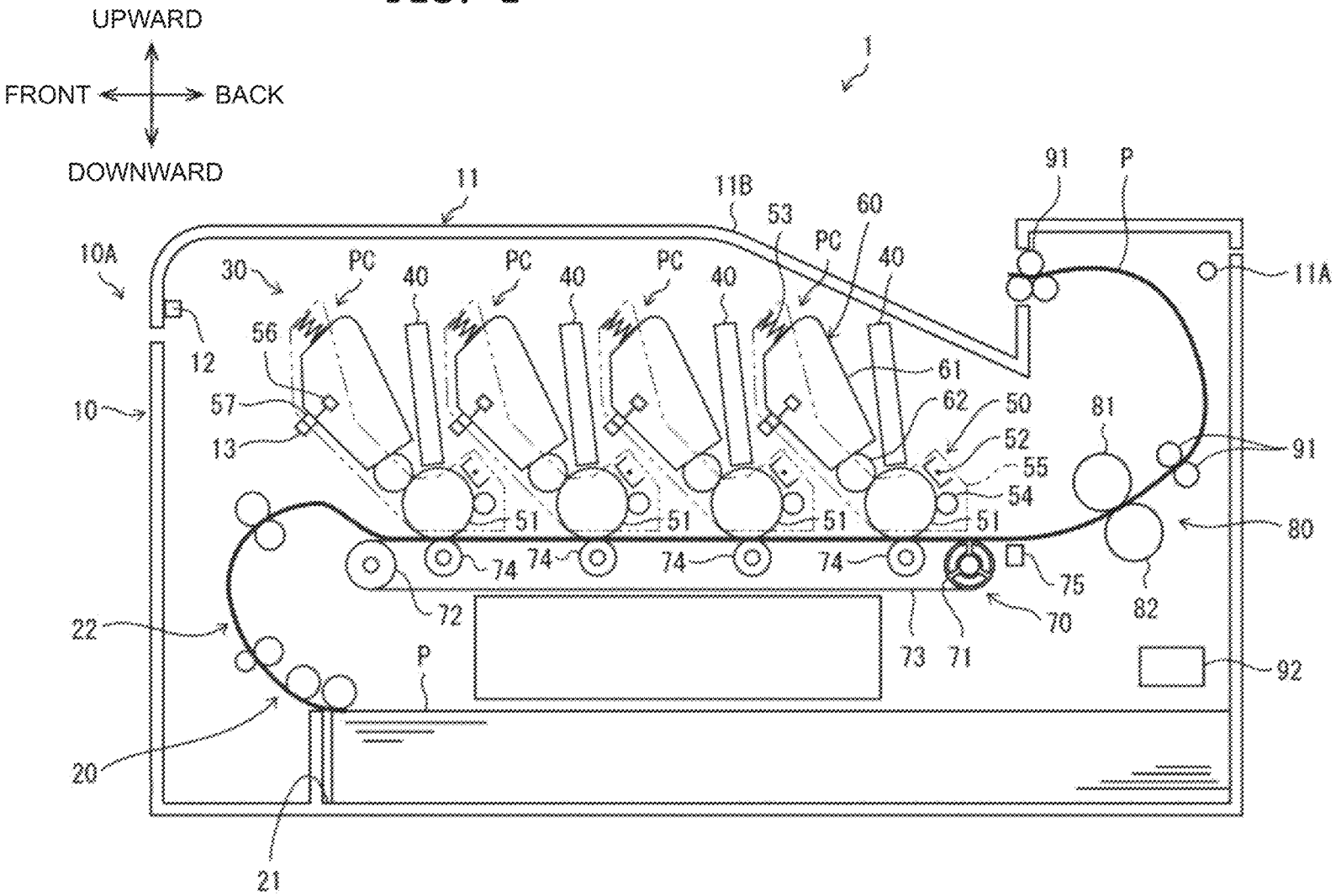
FIG. 1 is a drawing illustrative of schematic configuration of a color printer.

In the case of the technique disclosed in Japanese Patent Application Laid-open No. 2011-154146, when the toner patch for correcting the developing bias having a high exposure area ratio is used, the change of the reflected light amount is small with respect to the change of the developing bias. Therefore, a problem arises such that it is difficult to measure the correct density of the toner patch. An object of the present disclosure is to make it possible to correctly correct the developing bias in an image forming apparatus even in the case of a high exposure area ratio.

According to an aspect of the present disclosure, it is possible to correctly correct the developing bias in the image forming apparatus even in the case of the high exposure area ratio.

An embodiment of the present disclosure will be explained in detail below. Note that for the convenience of explanation, the same reference numerals are affixed to the same members, and names and functions thereof are the same as well. Therefore, any detailed explanation of which will not be repeated.

(Configuration of Color Printer 1)

FIG. 1 is a drawing illustrative of schematic configuration of a color printer 1 according to an embodiment of the present disclosure. As depicted in FIG. 1, the color printer 1, which is an example of the image forming apparatus, is provided with a casing 10, a sheet supply unit 20, and an image forming unit 30. In FIG. 1, as for the directions concerning the color printer 1, the left side as viewed in FIG. 1 is designated as "front", the right side is designated as "back", the upper side is designated as "upward", and the lower side is designated as "downward".

The casing 10 is provided with an opening 10A and a cover 11 with which the opening 10A is openable/closable. The cover 11 is arranged on a side relevant to exposure heads 40 opposite to a side on which photosensitive members 51 are arranged in relation to the upward-downward direction, specifically at an upper portion of the casing 10. The cover 11 is supported rotatably about the center of a rotation shaft 11A which is provided at a back portion of the casing 10. The cover 11 opens/closes the opening 10A formed for the casing 10. The cover 11 is rotatable between a closed position (position depicted in FIG. 1) at which the opening 10A is closed and an open position at which the opening 10A is open. A cover sensor 12 is a sensor which detects the open situation and the closed situation of the cover 11. If the cover 11 is opened, the cover sensor 12 outputs an ON signal until the cover 11 is closed.

Further, the casing 10 is provided with a temperature sensor 92 which is provided in the vicinity of the inside of an unillustrated inlet port and which acquires the atmospheric temperature of the color printer 1.

The sheet supply unit 20 is provided at a lower portion in the casing 10. The sheet supply unit 20 is provided with a sheet tray 21 and a pickup roller 22. The sheet tray 21 accommodates sheets P. The pickup roller 22 supplies the sheet P from the sheet tray 21 to the image forming unit 30. The sheets P accommodated in the sheet tray 21 are supplied to the image forming unit 30 while being separated one by one by the pickup roller 22.

The image forming unit 30 is arranged over or above the sheet tray 21 in the casing 10. The image forming unit 30 is provided with a plurality of exposure heads 40, a plurality of process cartridges PC as examples of a plurality of photosensitive cartridges, a transfer unit 70, and a fixing unit 80. With reference to FIG. 1, the number of the exposure heads 40 is four, and the number of the process cartridges PC is four.

The exposure head 40 is an exposure device for exposing the photosensitive member 51. The exposure head 40 is supported by the cover 11 so that the exposure head 40 hangs from the cover 11. The exposure head 40 is arranged opposingly over or above the photosensitive member 51 in the state in which the cover 11 is closed. In particular, the exposure head 40 is movable between an exposure position at which the photosensitive member 51 is exposed (position depicted in FIG. 1) by the exposure head 40 and a retracted position at which the exposure head 40 is separated from the photosensitive member 51 as compared with the exposure position, in accordance with the opening/closing operation of the cover 11.

The plurality of process cartridges PC is arranged and juxtaposed in the front-back direction between the cover 11 and the sheet tray 21. The plurality of process cartridges PC is detachable with respect to the casing 10 via the opening 10A in the state in which the cover 11 is open. The process cartridge PC is provided with a drum unit 50 and a developing cartridge 60 as an example of the accommodating unit (container).

The drum unit 50 is provided with the photosensitive member 51, a charger 52, a pressing spring 53, a cleaning roller 54, a drum frame 55, a memory 56, and a cartridge side terminal 57. The photosensitive member 51 is a cylindrical drum on which a toner as an example of the developer is carried. The charger 52 electrifies the photosensitive member 51. The pressing spring 53 urges the developing cartridge 60 toward the photosensitive member 51 in the process cartridge PC. The cleaning roller 54 removes foreign matters such as the toner or the like remaining on the photosensitive member 51. The cleaning roller 54 is rotatable while making contact with the photosensitive member 51. The drum frame 55 supports, for example, the photosensitive member 51 in the process cartridge PC.

The memory 56 stores the information in relation to the process cartridge PC. The cartridge side terminal 57 is in conduction with the memory 56. Each of a plurality of casing side terminals 13 is provided on the casing 10 for each of process cartridges PC. When the corresponding process cartridge PC is provided in the casing 10, the casing side terminal 13 is connected to the cartridge side terminal 57 possessed by the process cartridge PC.

The developing cartridge 60 is a cartridge which is detachable with respect to the drum unit 50. The developing cartridge 60 is provided with a toner accommodating unit (toner container) 61 and a developing roller 62. The toner accommodating unit 61 accommodates, in the inside thereof, the toner having a specified color as an example of the developer. In particular, each of the toner accommodating units 61 accommodates the toner of any one of the colors of cyan (C), magenta (M), yellow (Y), and black (K). The developing roller 62 supplies the toner contained in the corresponding toner accommodating unit 61 to the corresponding photosensitive member 51. The toner is a positively chargeable toner of one non-magnetic component.

The process cartridge PC is attached/detached with respect to the casing 10 in the state in which the detachable developing cartridge 60 is installed to the process cartridge PC. The memory 56 may be provided on the developing cartridge 60. The memory 56 may be connected to the casing side terminal 13 by the aid of the cartridge side terminal 57 of the process cartridge PC. There is no limitation thereto. The developing cartridge 60 may be detachable with respect to the casing 10 distinctly from the process cartridge PC. Alternatively, the process cartridge PC may be provided with the developing roller 62 and the toner accommodating unit 61 as an example of the accommodating unit which is integrated into one unit with the process cartridge PC. In this exemplary case, the toner accommodating unit 61 and the developing roller 62 are not detachable with respect to the process cartridge PC.

The transfer unit 70 is provided between the sheet tray 21 and the process cartridge PC in the upward-downward direction. The transfer unit 70 is provided with a driving roller 71, a driven roller 72, a belt 73, a plurality of transfer rollers 74, and a sensor 75. The belt 73 is an endless belt which is provided to stretch between the driving roller 71 and the driven roller 72. The outer surface of the belt 73 is in contact with each of the photosensitive members 51. A toner image, which is formed by the toner, is transferred from each of the photosensitive members 51 to the outer surface of the belt 73. In this case, the toner image is an example of the developer image of the present disclosure. Each of the transfer rollers 74 is arranged at the inside of the belt 73 (i.e., at the inside of the ring formed by the endless belt 73) so that the belt 73 is interposed between each of the transfer rollers 74 and each of the photosensitive members 51. The sensor 75 is a sensor which is provided to perform, for example, a detecting (reading) process as described later on. The sensor 75 is arranged in the vicinity of the driving roller 71 at the outside of the belt 73 (i.e., at the outside of the ring formed by the endless belt 73). The sensor 75 is an optical sensor which detects (reads) the density of the toner image formed on the belt 73 by radiating the light onto the outer surface of the belt 73 and receiving the reflected light from the belt 73.

The fixing unit 80 is provided at the back of the process cartridge PC and the transfer unit 70. The fixing unit 80 is provided with a heating roller 81 and a pressing roller 82. The pressing roller 82 is arranged opposingly to the heating roller 81. The pressing roller 82 presses the heating roller 81.

The color printer 1 forms the image on the sheet P in accordance with the following procedure. At first, the image forming unit 30 uniformly electrifies the surface of each of the photosensitive members 51 by means of the charger 52. Subsequently, the photosensitive member 51 is exposed by means of the exposure head 40, and thus an electrostatic latent image is formed on the photosensitive member 51 on the basis of the image data. Then, the toner is supplied from the developing roller 62 to the photosensitive member 51 by applying the developing bias to the developing roller 62, and the electrostatic latent image is converted into a visible image. Further, the developing bias has the same polarity as the polarity of the toner. The developing bias is the bias amount (deflection amount) of the voltage applied to the developing roller 62. The toner image is formed on the photosensitive member 51 by applying the developing bias. The image forming unit 30 successively superimposes and transfers the toner images formed on the respective photosensitive members 51 onto the sheet P conveyed on the belt 73 moved by means of the driving roller 71 and the driven roller 72. The sheet P, to which the toner images have been transferred, is conveyed between the heating roller 81 and the pressing roller 82 by the transfer unit 70. The fixing unit 80 thermally fixes the toner images to the sheet P by heating the sheet P by means of the heating roller 81. After that, the color printer 1 discharges the sheet P to the outside from the inside of the casing 10 by means of the conveying roller 91. The sheet P is placed on a discharge sheet tray 11B provided on the upper surface of the cover 11.

Note that the image forming unit 30 may form an image on the sheet P in accordance with the intermediate transfer system. According to the intermediate transfer system, the image forming unit 30 once forms the toner image on the outer surface of the belt 73, and then the toner image on the belt 73 is transferred to the sheet P.

(Functional Configuration of Color Printer 1)

Figure 2:
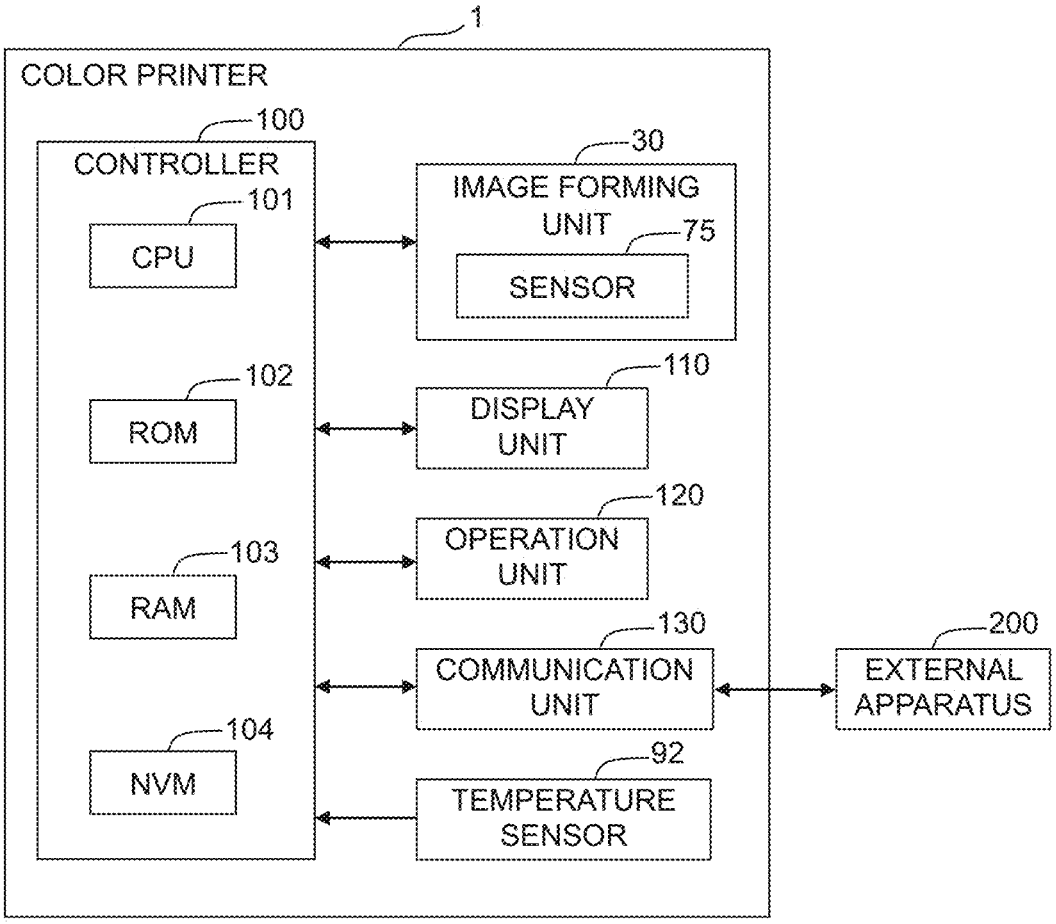
FIG. 2 is a block diagram illustrative of functional configuration of the color printer.

FIG. 2 is a block diagram illustrative of functional configuration of the color printer 1 according to the embodiment of the present disclosure. However, in FIG. 2, some of the members provided for the color printer 1 depicted in FIG. 1 are omitted from the illustration. As depicted in FIG. 2, the color printer 1 is provided with a controller (control unit) 100; the image forming unit 30 having, for example, the sensor 75; a display unit 110; an operation unit 120; a communication unit 130; and the temperature sensor 92. The controller 100 is electrically connected to the image forming unit 30, the display unit 110, the operation unit 120, and the communication unit 130. The controller 100 is provided with CPU (Central Processing Unit) 101, ROM (Read Only Memory) 102, RAM (Random Access Memory) 103, and NVM (Non-Volatile Memory) 104 as an example of the storage unit (storage).

CPU 101 performs the processing in accordance with the program read from ROM 102. CPU 101 controls the respective parts of the color printer 1 while storing the result of the processing in RAM 103 or NVM 104. ROM 102 stores various programs. The various programs include, for example, a program for controlling the respective parts of the color printer 1. RAM 103 is utilized as a working area and a temporary storage area for data when CPU 101 executes the various programs. NVM 104 is a rewritable non-volatile memory.

The display unit 110 has a liquid crystal display. The display unit 110 displays, for example, various setting screens and operation states of the color printer 1. The operation unit 120 has a plurality of buttons. The operation unit 120 accepts various input instructions performed by a user. The communication unit 130 performs the communication with an external apparatus 200 such as PC (Personal Computer) or the like in accordance with the wireless communication system or the wired communication system so as to receive the data. The communication unit 130 is an interface such as LAN (Local Area Network) or the like. Note that the communication unit 130 may perform the communication with a plurality of external apparatuses 200.

(Control Method for Color Printer 1)

Figure 3A:
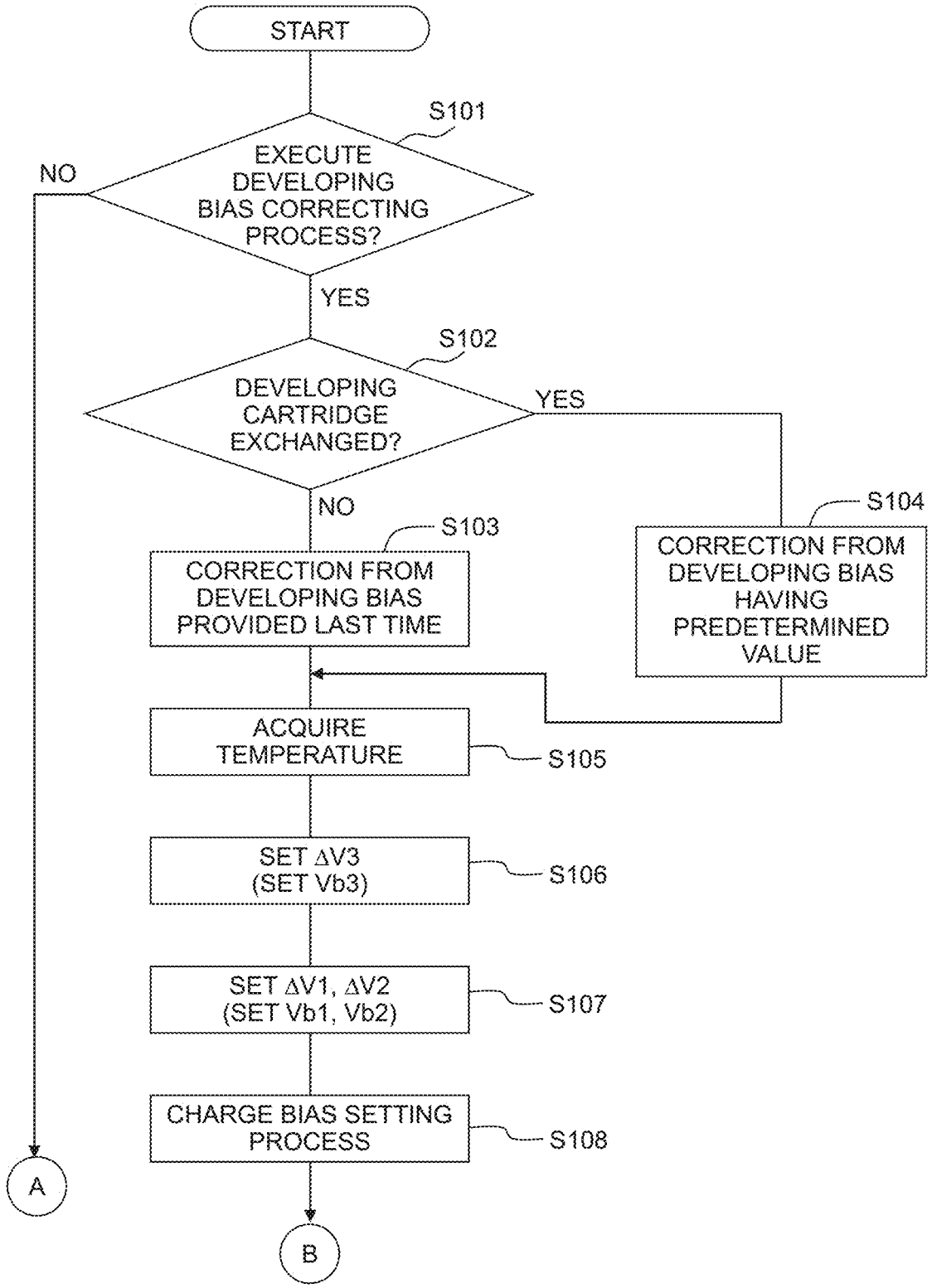
FIGS. 3A and 3B are flow charts illustrative of a flow of the process when a developing bias correcting process and a gamma correcting process are executed in a control method for the color printer.
Figure 3B:
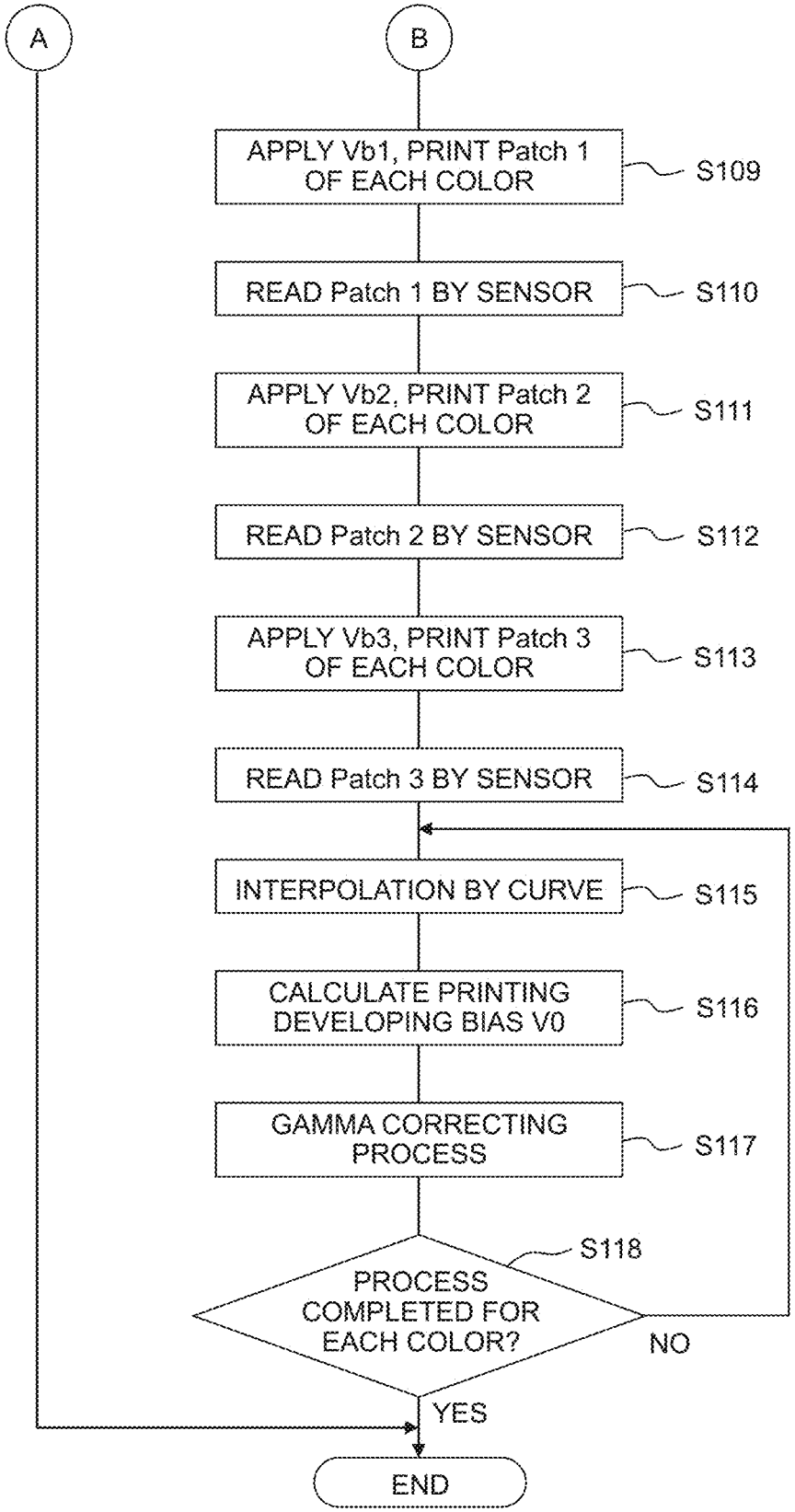

FIGS. 3A and 3B are flow charts illustrative of a flow of the process when a developing bias correcting process for correcting the printing developing bias (developing bias for printing; an example of "developing bias") applied to the developing roller 62 and a gamma correcting process are executed in a control method for the color printer 1 according to the embodiment of the present disclosure. The process depicted in the flow charts of FIGS. 3A and 3B may be executed, for example, when the color printer 1 is started up or when the cover sensor 12 detects the closing of the cover 11. Note that the order or sequence of the execution of the respective steps of the process depicted in FIGS. 3A and 3B is not limited to that described in the following explanation.

In S101, the controller 100 determines whether or not the condition to start the developing bias correcting process is fulfilled. In this context, the situation, in which the foregoing condition is fulfilled, is exemplified by the following situations.

Situation in which the printing process is executed for a predetermined number of sheets after executing the developing bias correcting process last time.

Situation in which the atmospheric temperature acquired by the temperature sensor 92 is changed by not less than a predetermined temperature after executing the developing bias correcting process last time.

Situation in which the developing cartridge 60 for accommodating the toner is exchanged.

Situation in which the operation unit 120 or the communication unit 130 receives the command to execute the developing bias correction.

Further, without being specifically limited, the predetermined number of sheets may be, for example, 1000, and the predetermined temperature may be, for example, 6 degrees centigrade.

If the controller 100 determines in S101 that the foregoing condition is fulfilled, the controller 100 subsequently determines in S102 whether or not the foregoing condition is fulfilled by the exchange of the developing cartridge 60. On the other hand, if the controller 100 determines that the foregoing condition is not fulfilled, the process based on the flow charts depicted in FIGS. 3A and 3B is terminated.

If the controller 100 determines in S102 that the foregoing condition is fulfilled by any factor other than the exchange of the developing cartridge 60, the printing developing bias, which has been set in the developing bias correcting process performed last time, is set in S103 as the old developing bias which serves as the reference for the correction in the developing bias correcting process performed this time. The old developing bias is the printing developing bias provided before executing the developing bias correcting process this time.

Note that the controller 100 may perform a process for changing (updating) the printing developing bias in accordance with the increase in the number of printed sheets after setting the printing developing bias in the developing bias correcting process performed last time. In this case, the printing developing bias, which is provided just before the execution of the developing bias correcting process performed this time, may be set as the old developing bias.

If the controller 100 determines in S102 that the foregoing condition is fulfilled by the exchange of the developing cartridge 60, the controller 100 sets the developing bias having the predetermined value as the old developing bias in S104. In other words, if the developing cartridge 60 is exchanged, the controller 100 uses the developing bias having the predetermined value as the old developing bias without using the printing developing bias set in the developing bias correcting process performed last time. Further, the developing bias having the predetermined value may be a fixed value which is prescribed for a new developing cartridge 60, or the developing bias having the predetermined value may be a value corresponding to the information recorded in the memory 56 carried or mounted on the developing cartridge 60.

Subsequently, the controller 100 executes a setting process for setting a plurality of testing developing biases (developing biases for testing; an example of "testing biases"), all (each) of the plurality of testing developing biases being smaller than the old developing bias. For example, in the setting process, the controller 100 may set three-valued testing developing biases as the plurality of testing developing biases in accordance with the steps S105 to S107 as follows.

In the following description, an explanation will be made assuming that the three-valued testing developing biases are Vb1 as the first value, Vb2 as the second value, and Vb3 as the third value as referred to in this order starting from small one. Further, the first difference value between Vb1 and Vb2 is designated as ΔV1, the second difference value between Vb2 and Vb3 is designated as ΔV2, and the third difference value between the old developing bias and Vb3 is designated as ΔV3.

Note that in the case of the configuration in which the negatively chargeable toner is used and the developing bias having the negative polarity is applied, the small developing bias means the small absolute value of the developing bias, i.e., the small bias amount from the reference electric potential.

In S105, the temperature sensor 92 acquires the atmospheric temperature of the color printer 1.

In S106, the controller 100 sets ΔV3. In other words, the controller 100 sets Vb3. Further, in the setting process, the controller 100 may change the magnitude of ΔV3 depending on the atmospheric temperature acquired by the temperature sensor 92. For example, the lower the atmospheric temperature is, the larger set ΔV3 is. Accordingly, it is possible to form the toner image by using the preferred developing bias adapted to the atmospheric temperature. Usually, the lower the atmospheric temperature is, the higher the charge amount of the toner is. In this situation, the density change of the toner image, with respect to the change of the developing bias, is decreased. On this account, it is desirable to set the large ΔV3 in order to lower the density of the toner image in the environment in which the atmospheric temperature is low.

In S107, the controller 100 sets ΔV1 and ΔV2. In other words, the controller 100 sets Vb1 and Vb2.

Further, the controller 100 may set Vb1, Vb2, and Vb3 in the setting process so that ΔV1 is equal to ΔV2. Further, the controller 100 may set Vb1, Vb2, and Vb3 in the setting process so that ΔV3 is larger than ΔV1 and ΔV2. Accordingly, the plurality of testing developing biases are used, in each of which the difference is large with respect to the old developing bias. Therefore, it is possible to more decrease the density of the toner image, and it is possible to more correctly correct the developing bias in the color printer 1. For example, the controller 100 may set ΔV1 to 40 (V), ΔV2 to 40 (V), and ΔV3 to 100 (V).

Note that the values of Vb1, Vb2, and Vb3 may be different from each other for each of the colors. That is, for example, it is not necessarily indispensable that Vb1 corresponding to the first color is the same as Vb1 corresponding to the second color different from the first color.

In S108, the controller 100 executes a charge bias setting process for setting the magnitude of the charge bias applied to the charger 52 depending on the magnitudes of the testing developing biases, i.e., the magnitudes of Vb1, Vb2, and Vb3.

In S109, the controller 100 controls the image forming unit 30 to apply the developing bias Vb1 to the developing roller 62 so that the toner patch "Patch 1", which is an example of the toner image, is formed for each color on the surface of the belt 73. Subsequently, in S110, the controller 100 detects the density dens1 of the toner patch formed by using the developing bias Vb1, by means of the sensor 75. The values of dens1 for four colors may be different from each other, the values of dens2 (described later on) for four colors may be different from each other, and the values of dens3 (described later on) for four colors may be different from each other.

In S111, the controller 100 controls the image forming unit 30 to apply the developing bias Vb2 to the developing roller 62 so that the toner patch "Patch 2" of each color is formed on the surface of the belt 73. Subsequently, in S112, the controller 100 detects the density dens2 of the toner patch formed by using the developing bias Vb2, by means of the sensor 75.

In S113, the controller 100 controls the image forming unit 30 to apply the developing bias Vb3 to the developing roller 62 so that the toner patch "Patch 3" of each color is formed on the surface of the belt 73. Subsequently, in S114, the controller 100 detects the density dens3 of the toner patch formed by using the developing bias Vb3, by means of the sensor 75.

Figure 4:
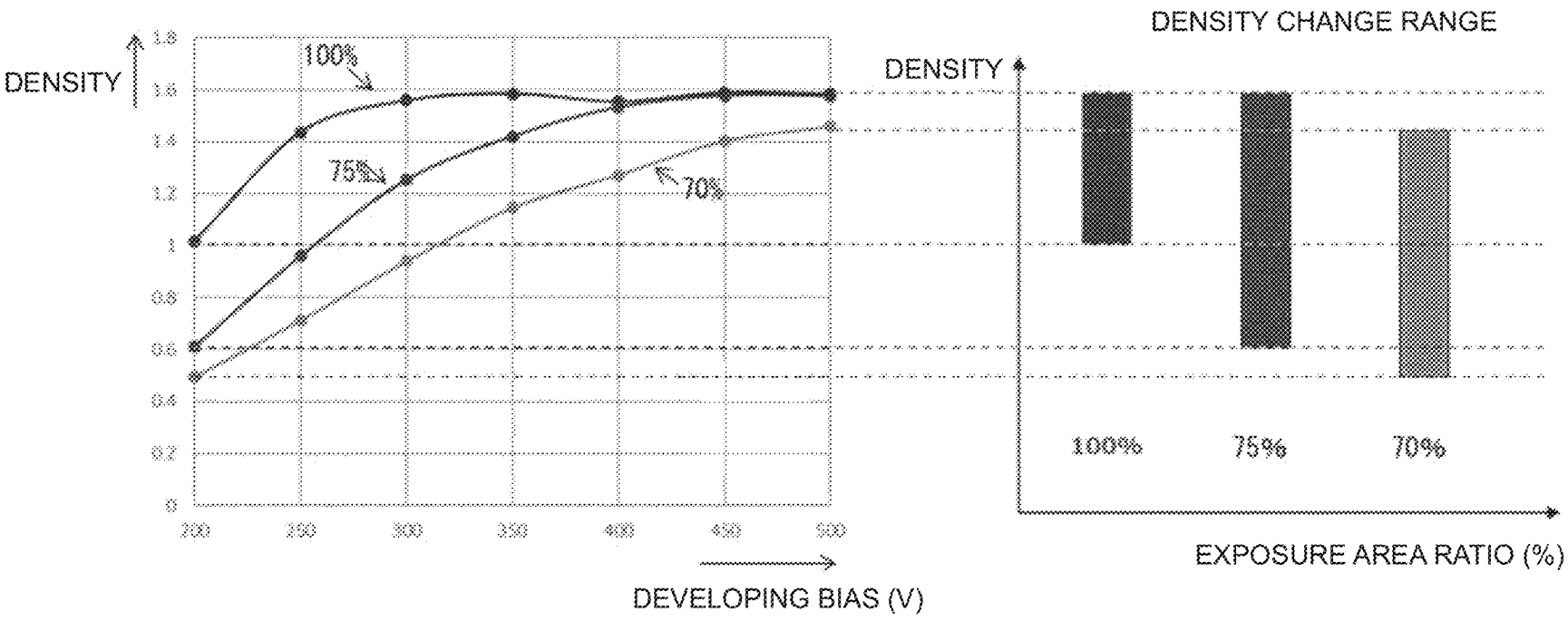
FIG. 4 on the left side is a drawing to show a relationship between the developing bias and the density in relation to developer images corresponding to respective exposure area ratios.

The explanation on the toner patch, which is formed on the belt 73 in the steps of S109, S111, and S113, will be supplemented. FIG. 4 on the left side is a drawing to show a relationship between the developing bias and the density in relation to toner patches corresponding to respective exposure area ratios of 100%, 75%, and 70%. Further, FIG. 4 on the right side is a drawing to show the range of the change of the density of the toner patch corresponding to each of the exposure area ratios described above.

In each of the steps described above, the toner patch on the belt 73 is formed with the exposure area ratio which is equal in relation to each of the colors. Further, the exposure area ratio means the ratio of the area for exposing the photosensitive member 51 in the range in which the electrostatic latent image, which corresponds to the binarized image, is formed on the photosensitive member 51.

In relation to each of the colors, the following configuration is desirable. That is, the target density, which is the density as the target, is included in the range in which the density of the toner patch is changed. Further, the toner patch is formed with the exposure area ratio in which the range of the change of the density is large in order to allow the sensor 75 to acquire the appropriate density value (gradation value). In an exemplary case depicted in FIG. 4, the target density is 1.38. Therefore, it is desirable that the toner patch, which corresponds to the exposure area ratio of 75%, is formed.

Figure 5:
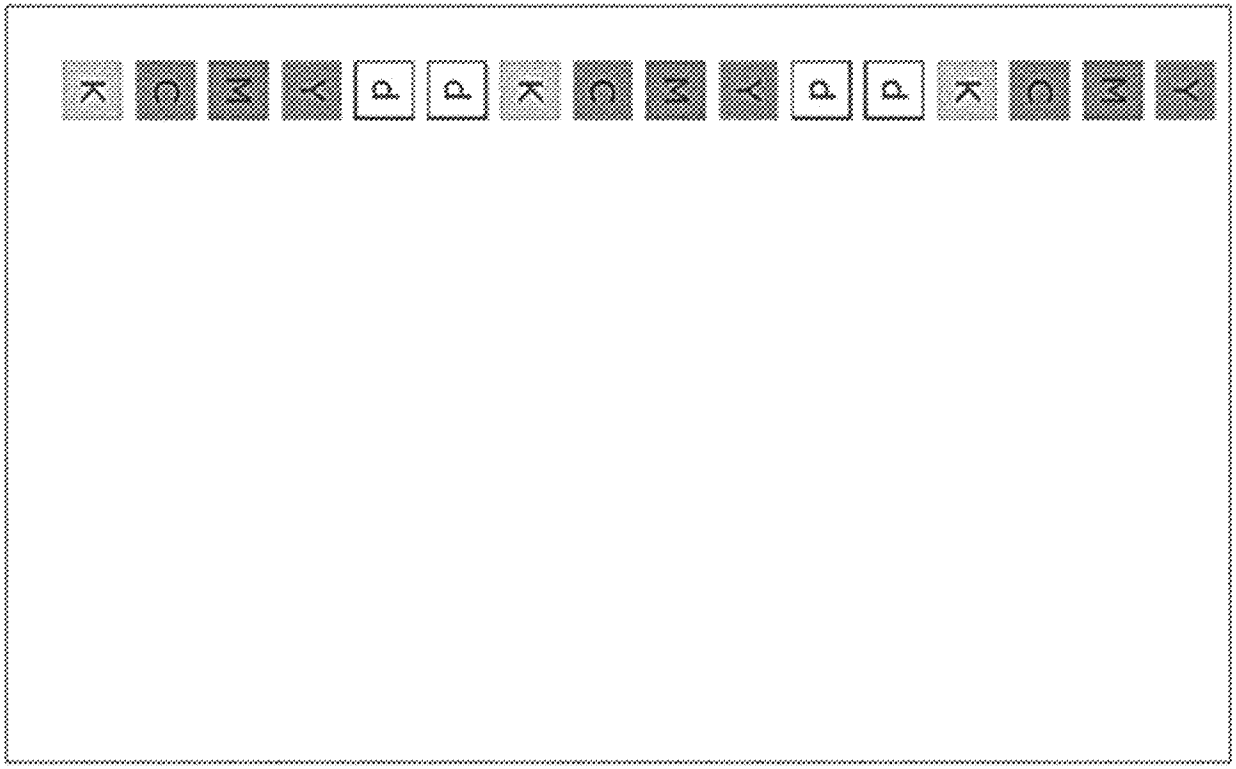
FIG. 5 is an example of a toner patch formed on a belt.

FIG. 5 is an example of the toner patches formed on the belt 73. Each of three groups of continuous "YMCK", which are depicted in FIG. 5, represents the toner patches of the four colors formed in one of S109, S111, and S113. Further, a dummy toner patch "d", which is depicted in FIG. 5, indicates that the space is provided between the groups, of the toner patches of YMCK of the four colors, formed with the different testing developing biases.

In other words, in relation to the processes of S109 to S114 described above, the controller 100 executes a forming process and a detecting process as described below. That is, as the forming process described above, the controller 100 forms the plurality of toner patches on the belt 73 by using the plurality of testing developing biases Vb1 to Vb3 set in the setting process of S105 to S107. As the detecting process described above, the controller 100 detects the densities dens1 to dens3 of the plurality of toner patches formed by the forming process described above by means of the sensor 75.

Further, as described above, in the forming process, the controller 100 may form the toner patches corresponding to the exposure area ratios of not less than 60% and less than 100% on the belt 73 by using the plurality of testing developing biases, respectively. It is possible to preferably acquire the gradation performance of the density in the high density area by using the high density toner patch as the reference for the developing bias correcting process.

Figure 6:
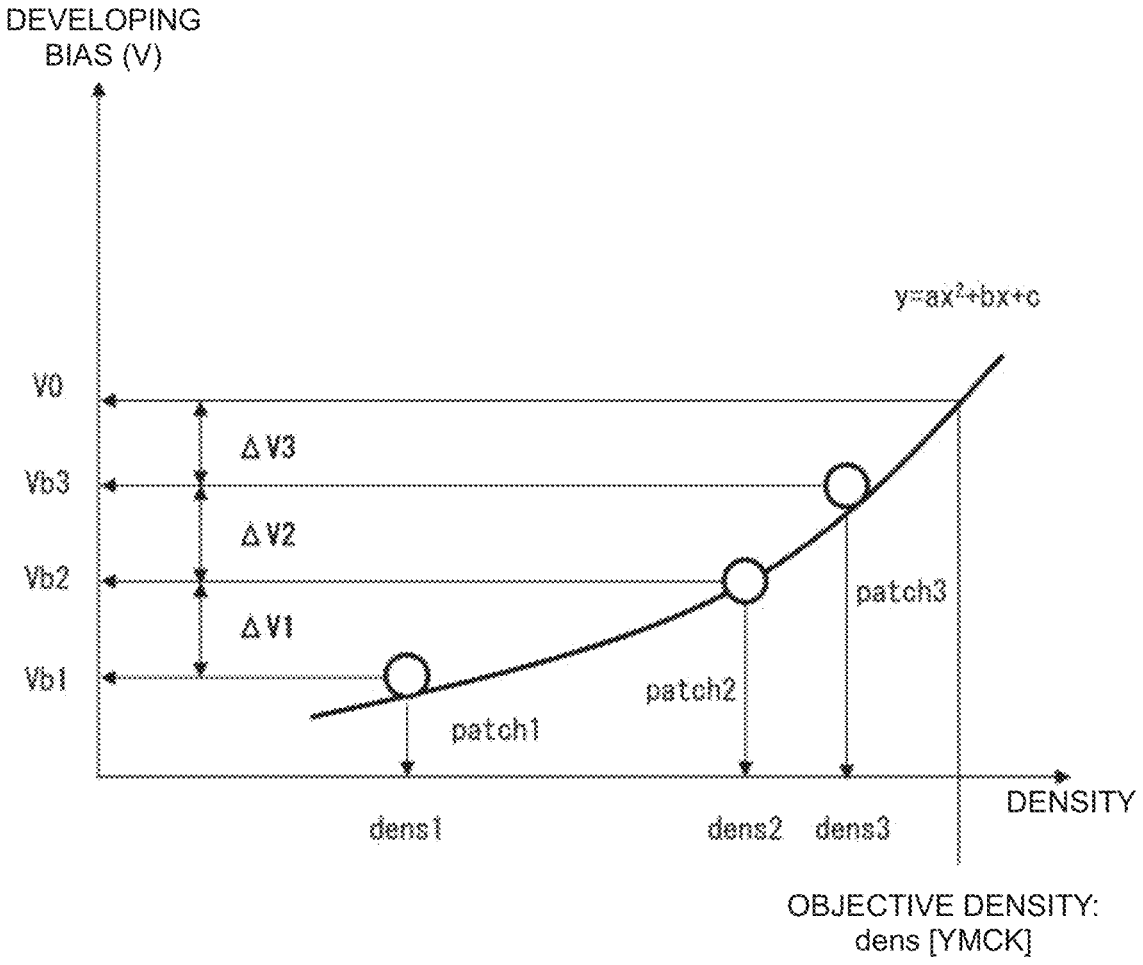
FIG. 6 is a drawing to show the relationship between the densities of the respective toner patches detected in a detecting process and the developing biases corresponding to the respective densities.

In S115, the controller 100 performs, in relation to the target color, the interpolation by the curve, for example, by means of the polynomial approximation on the basis of the coordinate value prescribed by the testing developing bias Vb1 to Vb3 and the density of the toner patch formed by using each of the testing developing biases, the density being detected in the detecting process. FIG. 6 is a drawing to show the relationship between the densities and the developing biases corresponding to the respective densities.

In relation to FIG. 6, for example, assuming that x1=dens1, x2=dens2, x3=dens3, y1=Vb1, y2=Vb2, y3=Vb3 are given, the coefficients a, b, c of the curve y=ax^2+bx+c passing through the points (dens1, Vb1), (dens2, Vb2), (dens3, Vb3) may be derived for each color, for example, in accordance with the following expression.

$$a=(x2*y3-x1*y3-x3*y2+x1*y2+x3*y1-x2*y1)/((x2-x1)*(x3-x1)*(x3-x2))$$

$$b=-(x2^2*y3-x1^2*y3-x3^2*y2+x1^2*y2+x3^2*y1-x2^2*y1)/((x2-x1)*(x3-x1)*(x3-x2))$$

$$c=(x1*x2^2*y3-x1^2*x2*y3-x1*x3^2*y2+x1^2*x3*y2+x2*x3^2*y1-x2^2*x3*y1)/((x2-x1)*(x3-x1)*(x3-x2))$$

In S116, the controller 100 executes a calculating process for calculating the printing developing bias V0 in accordance with the densities of the plurality of toner patches detected in the detecting process in relation to the target color. The printing developing bias V0 is derived by substituting the expression of the curve described above with dens[YMCK] as the value to indicate the objective density of the target color as follows.

$$V0=a*(\mathrm{dens}[YMCK])^2+b*(\mathrm{dens}[YMCK])+c$$

Further, the controller 100 may be configured such that the printing developing bias, which is provided when an electrostatic latent image on the photosensitive member 51 corresponding to a solid image is developed, is set to a value to move only a part of the toner on the developing roller 62 to the electrostatic latent image in the calculating process. In other words, the controller 100 may be configured such that the printing developing bias, which is provided when an electrostatic latent image on the photosensitive member 51 corresponding to a solid image is developed, is set to a value not to move all of the toner on the developing roller 62 to the electrostatic latent image (that is, a value to move a part of the toner on the developing roller 62 to the electrostatic latent image). In this case, the exposure area ratio of the electrostatic latent image on the photosensitive member 51 corresponding to the solid image described above is 100%.

Figure 7:
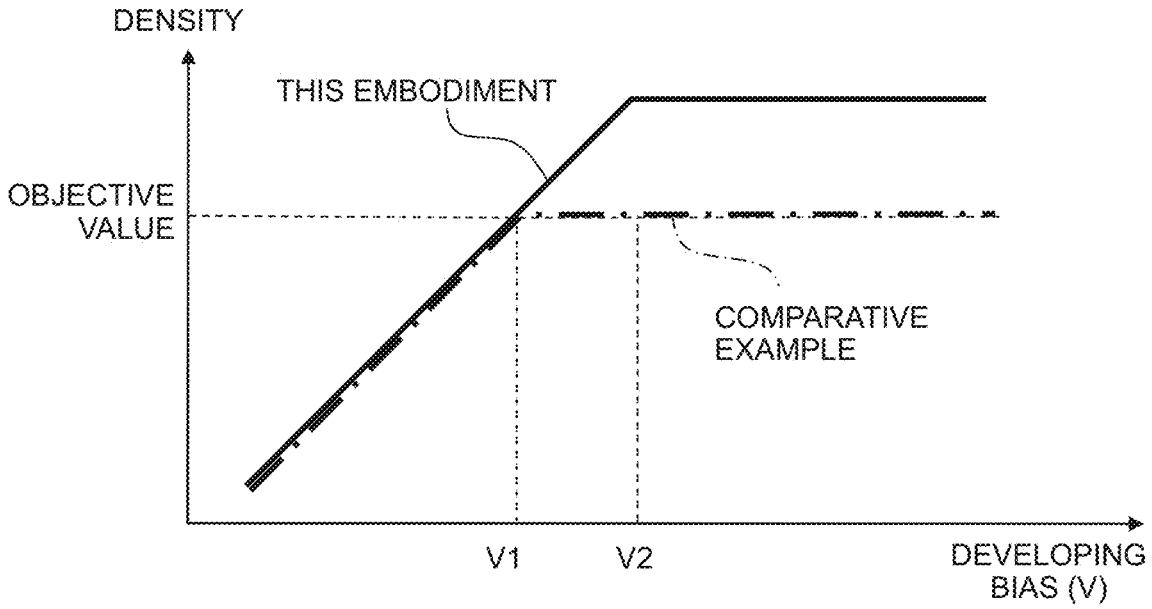
FIG. 7 is a drawing to show the relationship between the developing bias and the density of the developer image.

FIG. 7 is a drawing to show the relationship between the developing bias and the density of the toner image. In the configuration shown in Comparative Example of FIG. 7, when an electrostatic latent image on the photosensitive member 51 corresponding to a solid image is developed, all of the toner, which is carried on the developing roller 62 and which can be moved by the electric field, is moved to the electrostatic latent image. In the configuration of Comparative Example, for example, if the speed fluctuation occurs in the developing roller 62, it is feared that the toner supply amount to the electrostatic latent image may be fluctuated, and the printing density change may be caused by the fluctuation of the circumferential speed (peripheral speed) of the developing roller. On this account, it is difficult to suppress the occurrence of the printing density change caused by the fluctuation of the circumferential speed of the developing roller.

On the other hand, in this embodiment shown in FIG. 7, i.e., in the foregoing configuration of the present disclosure, even when an electrostatic latent image on the photosensitive member 51 corresponding to a solid image is developed, the toner carried on the developing roller 62 remains. For example, assuming that the "objective value" shown in FIG. 7 is the density corresponding to the solid image, V1 is set as the printing developing bias. However, in this embodiment, the toner, which can be supplied from the developing roller 62, does not arrive at the upper limit until arrival at the amount at which the developing bias exceeds V2. Accordingly, even when the speed fluctuation occurs in the developing roller 62, the amount of the toner supplied from the developing roller 62 is kept to be the amount which depends on the electric field, i.e. the amount which depends on the printing developing bias V1. Therefore, it is possible to suppress the occurrence of the printing density change.

In S117, the controller 100 executes a gamma correcting process as described below after executing the developing bias correcting process in relation to the target color. That is, the controller 100 forms the toner patches corresponding to the plurality of mutually different exposure area ratios on the belt 73 respectively by using the printing developing bias set in the developing bias correcting process, and the controller 100 sets the exposure area ratio corresponding to the density of the input image. Accordingly, it is possible to perform the correction for the printing density corresponding to the exposure area ratio different from the exposure area ratio used when the toner patch is formed on the belt 73. Further, it is possible to correct the printing density so that the stable output density is also obtained for the exposure area ratio in the vicinity of the intermediate density by executing the gamma correcting process after correcting the printing density corresponding to the high exposure area ratio.

In S118, the controller 100 determines whether or not the developing bias correcting process and the gamma correcting process are completed for all of the respective colors to be processed. If the controller 100 determines that the process is completed for the respective colors, the process based on the flow charts depicted in FIGS. 3A and 3B is terminated. If the controller 100 determines that the process is not completed for any certain color, the process of S115 and the followings are executed for the color.

Note that the configuration may be made such that the gamma correcting process is executed after the developing bias correcting process is completed for all of the respective colors to be processed.

As described above, the control method for the color printer 1 includes at least the following forming step and the following calculating step when the developing bias correcting process is executed. That is, in the forming step, as depicted in S106 and S107, the controller 100 sets the plurality of testing developing biases all of which are smaller than the old developing bias. Then, as depicted in S109, S111, and S113, the controller 100 forms the plurality of toner patches on the belt 73. Further, in the calculating step, as depicted in S116, the controller 100 calculates the printing developing biases in accordance with the densities of the plurality of toner patches on the belt 73.

According to the configuration as described above, the toner patch, which has the density smaller than the density corresponding to the objective developing bias, is the target to be detected by the sensor 75. Therefore, the change of the reflected light amount from the belt 73 is relatively large with respect to the change of the developing bias. The detecting accuracy is improved. Accordingly, it is possible to correctly correct the developing bias in the color printer 1 even in the case of the high exposure area ratio.

[Exemplary Realization by Software]

The controller 100 may be realized by a logic circuit (hardware) formed, for example, on an integration circuit (IC chip), or the controller 100 may be realized by a software.

In the case of the latter, the controller 100 is provided with a computer for executing the command of the program as the software for realizing the respective functions. The computer is provided with, for example, one or more processor or processors, and the computer is provided with a computer-readable recording medium which stores the program. Then, in the computer, the processor reads the program from the recording medium, and the processor executes the program. Thus, the object of the present disclosure is achieved. As for the processor, for example, it is possible to use CPU (Central Processing Unit). As for the recording medium, it is possible to use, for example, "non-transitory tangible medium" including, for example, ROM (Read Only Memory) as well as tape, disk, card, semiconductor memory, programmable logic circuit and the like. The system may further comprise, for example, RAM (Random Access Memory) for developing the program. Further, the program may be supplied to the computer via any arbitrary transmission medium (for example, communication network and broadcast wave) which can transmit the program. Note that an aspect of the present disclosure can be also realized by a form of data signal embedded in the carrier wave in which the program is realized by the electronic transmission.

The present invention is not limited to the respective embodiments described above. The present invention can be variously changed within a range defined in claims. Any embodiment, which is obtained by appropriately combining the technical means disclosed in the different embodiments respectively, is also included in the technical scope of the present invention.

Note that the above embodiment is configured such that the color printer 1 is provided with the exposure head 40 as the exposure device for exposing the photosensitive member 51. However, there is no limitation thereto. It is also allowable to adopt such configuration that a laser scanner is provided as the exposure device.

Further, the above embodiment is configured such that the color printer 1 uses the positively chargeable toner, and the developing bias having the positive polarity is applied. However, there is no limitation thereto. It is also allowable to adopt such configuration that a negatively chargeable toner is used, and a developing bias having the negative polarity is applied.

An image forming apparatus according to an aspect of the present disclosure includes a photosensitive member; a developing roller configured to supply a developer to the photosensitive member; a belt to which a developer image formed by the developer is to be transferred from the photosensitive member; a sensor configured to detect a density of the developer image on the belt; and a controller. The controller is configured to execute a developing bias correcting process for correcting a developing bias to be applied to the developing roller. The developing bias correcting process includes: a setting process for setting a plurality of testing biases to be applied to the developing roller, all of the plurality of testing biases being smaller than an old developing bias used for forming an image on a sheet before executing the developing bias correcting process; a forming process for forming a plurality of developer images on the belt by using the plurality of testing biases set in the setting process; a detecting process for detecting densities of the plurality of developer images formed in the forming process by the sensor; and a calculating process for calculating the printing developing bias based on the densities of the plurality of developer images detected in the detecting process.

According to the configuration as described above, the developer image, which has the density smaller than the density corresponding to the target developing bias, is the target for the detecting performed by the sensor. Therefore, the accuracy of the detecting is improved. Accordingly, it is possible to perform the correct correction of the developing bias in the image forming apparatus even in the case of the high exposure area ratio.

The controller may be configured to set, in the setting process, three-valued testing biases as the plurality of testing biases.

According to the configuration as described above, the developing bias and the coordinate value defined by the corresponding printing density are interpolated by a curve. By doing so, it is possible to correct the developing bias more correctly.

Provided that the three-valued testing biases are designated as a first value, a second value, and a third value as referred to starting from small value, the controller may be configured to set the first value, the second value, and the third value in the setting process so that a first difference value between the first value and the second value is equal to a second difference value between the second value and the third value.

According to the configuration as described above, it is possible to set the testing bias easily and conveniently.

The controller may be configured to set the first value, the second value, and the third value in the setting process so that a third difference value between the old developing bias and the third value is larger than the first difference value and the second difference value.

According to the configuration as described above, the plurality of testing biases, each of which has the large difference with respect to the developing bias set in the developing bias correcting process performed last time, are used. Therefore, it is possible to correct the developing bias more correctly in the image forming apparatus.

The image forming apparatus may further include a temperature sensor configured to acquire an atmospheric temperature of the image forming apparatus. The controller may be configured to change, in the setting process, the third difference value based on the atmospheric temperature acquired by the temperature sensor.

According to the configuration as described above, for example, the lower the atmospheric temperature is, the larger the third difference value to be set is. Accordingly, the developer image can be formed by using the preferred developing bias depending on the atmospheric temperature.

The controller may be configured to set, in the calculating process, the developing bias to be used in a case that an electrostatic latent image on the photosensitive member corresponding to a solid image is developed to a value at which only a part of the developer on the developing roller is moved to the electrostatic latent image.

According to the configuration as described above, the developer amount used for the printing can be controlled without depending on the circumferential speed of the developing roller. Therefore, it is possible to suppress the printing density change which would be otherwise caused by the fluctuation of the circumferential speed of the developing roller.

In the forming process, the controller may be configured to form, on the belt, the plurality of developer images each corresponding to exposure area ratio of not less than 60% and less than 100% by using the plurality of testing biases, respectively.

According to the configuration as described above, it is possible to preferably acquire the gradation performance in the high density area by using the high density developer image as the reference.

The image forming apparatus may further includes a charger configured to electrify a surface of the photosensitive member. The controller may be configured to execute a charge bias setting process for setting charge biases to be applied to the charger based on the plurality of testing biases.

According to the configuration as described above, it is possible to form the developer image on the belt by using the appropriate charge bias.

The controller may be configured to execute a gamma correcting process, after executing the developing bias correcting process, for forming, on the belt, a plurality of developer images corresponding to a plurality of mutually different exposure area ratios respectively using the developing bias set in the developing bias correcting process, and setting an exposure area ratio corresponding to a density of an input image.

According to the configuration as described above, the correction can be also performed for the printing density corresponding to the exposure area ratio different from one having been used as the reference when the developing bias correcting process is performed.

The controller may be configured to execute the developing bias correcting process in a case that a printing process is executed for a predetermined number of sheets after executing the developing bias correcting process last time.

According to the configuration as described above, it is possible to execute the developing bias correcting process in a case that the printing density is changed due to the change of the characteristic of the charge amount of the developer or the like caused by the continuation of the printing.

The image forming apparatus may further include a temperature sensor configured to acquire an atmospheric temperature of the image forming apparatus. The controller may be configured to execute the developing bias correcting process in a case that the atmospheric temperature acquired by the temperature sensor changes by not less than a predetermined value after executing the developing bias correcting process last time.

According to the configuration as described above, it is possible to execute the developing bias correcting process if the printing density is changed due to the change of the characteristic of the charge amount of the developer or the like caused by the change of the atmospheric temperature.

The image forming apparatus may further include a container configured to accommodate the developer. The controller may be configured to execute the setting process by using the developing bias having a predetermined value as the old developing bias in a case that the container is exchanged.

According to the configuration as described above, if the printing density is changed on account of the exchange to the container for accommodating the developer having the difference characteristic, it is possible to execute the developing bias correcting process.

A control method for an image forming apparatus according to another aspect of the present disclosure is a control method for an image forming apparatus provided with a photosensitive member, a developing roller configured to supply a developer to the photosensitive member, and a belt to which a developer image formed by the developer is to be transferred from the photosensitive member, the control method being used in a case that a developing bias correcting process for correcting a developing bias to be applied to the developing roller is executed, the control method including:

setting a plurality of testing biases to be applied to the developing roller, all of the plurality of testing biases being smaller than an old developing bias used for forming an image on a sheet before executing the developing bias correcting process, and forming a plurality of developer images on the belt by using the plurality of testing biases; and calculating the developing bias based on densities of the plurality of developer images on the belt.

According to the configuration as described above, the effect is obtained, which is the same as or equivalent to that obtained by the image forming apparatus according to the aspect of the present disclosure.

What is claimed is:

1. An image forming apparatus comprising:

a photosensitive member;

a developing roller configured to supply a developer to the photosensitive member;

a belt to which a developer image formed by the developer is to be transferred from the photosensitive member;

a sensor configured to detect a density of the developer image on the belt; and a controller configured to execute a developing bias correcting process for correcting a developing bias to be applied to the developing roller:

wherein the developing bias correcting process includes:

a setting process for setting a plurality of testing biases to be applied to the developing roller, all of the plurality of testing biases being smaller than an old developing bias used for forming an image on a sheet before executing the developing bias correcting process;

a forming process for forming a plurality of developer images on the belt by using the plurality of testing biases set in the setting process;

a detecting process for detecting densities of the plurality of developer images formed in the forming process by the sensor; and a calculating process for calculating the developing bias based on the densities of the plurality of developer images detected in the detecting process.

2. The image forming apparatus according to claim 1, wherein the controller is configured to set, in the setting process, three-valued testing biases as the plurality of testing biases.

3. The image forming apparatus according to claim 2, wherein provided that the three-valued testing biases are designated as a first value, a second value, and a third value as referred to starting from small value, the controller is configured to set the first value, the second value, and the third value in the setting process so that a first difference value between the first value and the second value is equal to a second difference value between the second value and the third value.

4. The image forming apparatus according to claim 3, wherein the controller is configured to set the first value, the second value, and the third value in the setting process so that a third difference value between the old developing bias and the third value is larger than the first difference value and the second difference value.

5. The image forming apparatus according to claim 4, further comprising a temperature sensor configured to acquire an atmospheric temperature of the image forming apparatus, wherein the controller is configured to change, in the setting process, the third difference value based on the atmospheric temperature acquired by the temperature sensor.

6. The image forming apparatus according to claim 1, wherein the controller is configured to set, in the calculating process, the developing bias to be used in a case that an electrostatic latent image on the photosensitive member corresponding to a solid image is developed to a value at which only a part of the developer on the developing roller is moved to the electrostatic latent image.

7. The image forming apparatus according to claim 1, wherein, in the forming process, the controller is configured to form, on the belt, the plurality of developer images each corresponding to exposure area ratio of not less than 60% and less than 100% by using the plurality of testing biases, respectively.

8. The image forming apparatus according to claim 1, further comprising a charger configured to electrify a surface of the photosensitive member, wherein:

the controller is configured to execute a charge bias setting process for setting charge biases to be applied to the charger based on the plurality of testing biases.

9. The image forming apparatus according to claim 1, wherein the controller is configured to execute a gamma correcting process, after executing the developing bias correcting process, for forming, on the belt, a plurality of developer images corresponding to a plurality of mutually different exposure area ratios respectively using the developing bias set in the developing bias correcting process, and setting an exposure area ratio corresponding to a density of an input image.

10. The image forming apparatus according to claim 1, wherein the controller is configured to execute the developing bias correcting process in a case that a printing process is executed for a predetermined number of sheets after executing the developing bias correcting process last time.

11. The image forming apparatus according to claim 1, further comprising a temperature sensor configured to acquire an atmospheric temperature of the image forming apparatus, wherein the controller is configured to execute the developing bias correcting process in a case that the atmospheric temperature acquired by the temperature sensor changes by not less than a predetermined value after executing the developing bias correcting process last time.

12. The image forming apparatus according to claim 1, further comprising a container configured to accommodate the developer, wherein:

the controller is configured to execute the setting process by using the developing bias having a predetermined value as the old developing bias in a case that the container is exchanged.

13. A control method for an image forming apparatus provided with a photosensitive member, a developing roller configured to supply a developer to the photosensitive member, and a belt to which a developer image formed by the developer is to be transferred from the photosensitive member, the control method being used in a case that a developing bias correcting process for correcting a developing bias to be applied to the developing roller is executed, the control method comprising:

setting a plurality of testing biases to be applied to the developing roller, all of the plurality of testing biases being smaller than an old developing bias used for forming an image on a sheet before executing the developing bias correcting process, and forming a plurality of developer images on the belt by using the plurality of testing biases; and calculating the developing bias based on densities of the plurality of developer images on the belt.

* * * * *